US007836669B1

(12) United States Patent
Cassil et al.

(10) Patent No.: US 7,836,669 B1
(45) Date of Patent: Nov. 23, 2010

(54) LID APPLYING APPARATUS AND METHOD WITH LID ORIENTING DEVICE

(75) Inventors: Donald W. Cassil, Chicago, IL (US); Paul D. Flint, Oak Park, IL (US); Curtis S. Shay, Plainfield, IL (US); James A. Rehak, Lansing, IL (US); Marcel Kubascik, Crown Point, IN (US)

(73) Assignee: The Sherwin Williams Company, Cleveland, OH (US)

( * ) Notice: Subject to any disclaimer, the term of this patent is extended or adjusted under 35 U.S.C. 154(b) by 676 days.

(21) Appl. No.: 11/684,197

(22) Filed: Mar. 9, 2007

Related U.S. Application Data

(60) Provisional application No. 60/780,764, filed on Mar. 9, 2006.

(51) Int. Cl.
*B67B 3/20* (2006.01)
*B65D 41/04* (2006.01)

(52) U.S. Cl. ..... 53/490; 53/505; 53/317; 220/288

(58) Field of Classification Search ..... 53/505, 53/485, 490, 286, 287, 300, 302, 303, 308, 53/310, 312, 317, 318; 220/288; 215/305
See application file for complete search history.

(56) References Cited

U.S. PATENT DOCUMENTS 2,731,185 A * 1/1956 Ranney et al. ..... 53/317
4,559,759 A * 12/1985 Herbert ..... 53/308
4,683,706 A * 8/1987 Harper ..... 53/485
5,012,630 A * 5/1991 Ingram et al. ..... 53/490
5,115,617 A * 5/1992 Lewis et al. ..... 53/306
5,321,934 A * 6/1994 Bech ..... 53/478
5,996,311 A * 12/1999 Heard et al. ..... 53/317
6,115,992 A * 9/2000 Bankuty et al. ..... 53/308
6,308,816 B1 * 10/2001 Bankuty et al. ..... 198/395
2004/0216430 A1 11/2004 Mavin

* cited by examiner

*Primary Examiner*—Paul R Durand
(74) *Attorney, Agent, or Firm*—Renner, Otto, Boisselle & Sklar LLP

(57) ABSTRACT

An apparatus and method for applying threaded lids to threaded necks of containers, wherein a lid orienting device is disposed in the transport path of the lid for engaging a leading side surface of a projection on the lid to cause the lid, as it moves past the lid orienting device, to rotate to a prescribed angular position relative to the transport path. The thread or threads of the lid then will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

18 Claims, 4 Drawing Sheets

LID APPLYING APPARATUS AND METHOD WITH LID ORIENTING DEVICE

RELATED APPLICATION DATA

This application claims the benefit of U.S. Provisional Application No. 60/780,764 filed Mar. 9, 2006, which is hereby incorporated herein by reference.

FIELD OF THE INVENTION

The invention herein described relates generally to an apparatus and method for applying a threaded lid to a threaded neck of a container, and more particularly to such an apparatus and method wherein a lid orienting device is employed to properly angularly position the lid relative to the threaded neck of the container to minimize if not eliminate cross-threading of the lid on the neck.

BACKGROUND

Automatic lid applying apparatus heretofore have been used to screw a threaded lid onto a threaded neck of a container to close the container after it has been filled. In a known lid applying apparatus, a lid is collected by a lid applying head that suspends the lid in a substantially horizontal plane. The lid is lowered onto the neck of the container to meet the lid and then the lid is rotated relative to the container thereby to screw the lid onto the neck.

A problem of cross-threading can arise if the lid is not placed on the neck so that the threads of the lid are in alignment with those of the neck. If the threads are cross-threaded, the subsequent forced application of the lid to the neck can result in the threads becoming damaged. This may lead to subsequent problems such a leakage.

U.S. Published Application No. 2004/0216430A proposes to solve the cross-threading problem by placing a lid (more specifically a cap) on the neck of a container and then rotating the lid relative to the neck in an opening direction. After such reverse rotation, the lid would be rotated in a closing direction. The rotation of the lid in the opening direction purportedly would correct any misalignment. That is, the threads presumably would settle into correct alignment prior to the application of the lid onto the neck of the container. This solution, however, requires the lid applying apparatus to be configured with a mechanism that can rotate the lid first in an opening direction and then in a closing direction, thereby increasing the complexity of the apparatus and the dwell time in the apparatus.

SUMMARY OF THE INVENTION

The present invention provides a unique apparatus and method for applying threaded lids to threaded necks of containers, wherein a lid orienting device is disposed in the transport path of the lid for engaging a leading side surface of a projection on the lid to cause the lid, as it moves past the lid orienting device, to rotate to a prescribed angular position relative to the transport path. The thread or threads of the lid then will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

According to one aspect of the invention, there is provided a lid applying apparatus for applying threaded lids to a threaded necks of containers, wherein the lids have at least one projection in known fixed relation to the internal lid thread or threads. The lid applying apparatus comprises a lid transport and a lid orienting device. The lid transport transports the lids sequentially along a transport path from a lid receiving station to a lid transfer station whereat each lid is engaged by a lid applying head used to position the lid on a threaded neck of a respective container and rotate the lid relative to the threaded neck to screw the lid to the threaded neck, the lid transport including a lid holder for holding the lid while allowing the lid to rotate about an axis that moves with the lid transport. The lid orienting device is disposed in the transport path of the lid for engaging a leading side surface of the projection on the lid to cause the lid, as it moves past the orienting device, to rotate about the axis that moves with the lid transport to a prescribed angular position relative to the transport path, whereby the thread or threads of the lid will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

The lid orienting device may include a finger extending into the path of the projection on the lid for engaging the leading side surface of the projection as the lid moves along the transport path. In a preferred embodiment, the finger is mounted for movement towards and away from the transport path of the lid between a fully extended position and a retracted position. The finger in the fully extended position extends into the path of a body portion of the lid from which the projection extends, and the lid orienting device further includes a finger retractor for retracting the finger to avoid engagement with the body portion of the lid as the lid moves past the lid orienting device. The finger retractor may include a cam follower connected to the finger, the cam follower being positioned to engage a cam surface on the lid transport to move the finger in an outward direction relative to the path of the body portion so as not to engage the body portion as the body portion moves past the lid orienting device.

The transport device may include a rotatable turntable, and the lid holder may be circumferentially spaced apart from other lid holders circumferentially arranged around the axis of the turntable. The turntable may have radially outwardly protruding surfaces each forming a curved cam surface associated with a respective lid holder, which cam surface may be engaged by the aforesaid cam follower.

In accordance with another aspect of the invention, there is provided a method of applying to a threaded neck of a container, lids that have at least one projection in known fixed relation to the internal lid thread or threads. The method comprises the steps of: (1) placing the lids on a lid holder of a lid transport that transports the lids sequentially along a transport path from a lid receiving station to a lid transfer station whereat each lid is engaged by a lid applying head used to position the lid on a threaded neck of a respective container and rotate the lid relative to the threaded neck to screw the lid to the threaded neck, the lid holder allowing the lid to rotate about an axis that moves with the lid transport; and (2) using a lid orienting device disposed in the transport path of the lid to engage a leading side surface of a projection on the lid to cause the lid, as it moves past the orienting device, to rotate about the axis that moves with the lid transport to a prescribed angular position relative to the transport path, whereby the thread or threads of the lid will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

Each lid preferably has at least two projections circumferentially spaced apart by no more than 180 degrees, and the lid orienting device is located to ensure that it will engage the leading side of one of the projections as the lid passes past the lid orienting device.

The foregoing and other features of the invention are hereinafter more fully described and particularly pointed out in the claims, the following description setting forth in detail certain illustrative embodiments of the invention, these being indicative, however, of but a few of the various ways in which the principles of the invention may be employed.

DETAILED DESCRIPTION

The principles of the present invention can be applied to various types of containers having threaded necks onto which internally threaded lids are applied. The present invention, however, is particularly applicable to a plastic container and lid assembly of the type described and shown in U.S. Pat. No. 6,983,862 which is hereby incorporated herein by reference in its entirety. Accordingly, an exemplary embodiment of the invention will be described in relation to such type of container and lid, although it should be understood that the invention can be applied to other types of container and lid (cap) assemblies as well.

Figure 1:
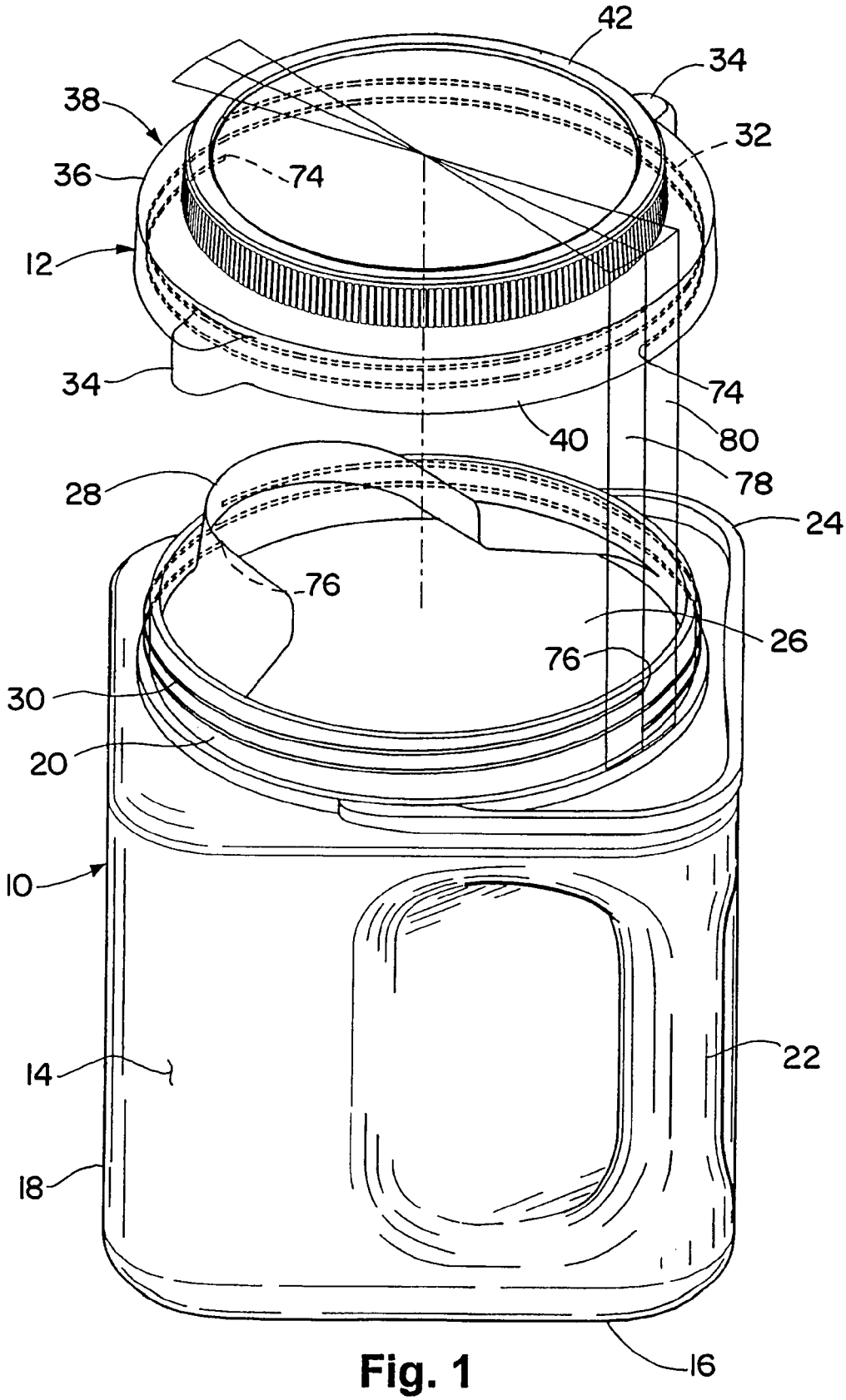
FIG. 1 is an exploded perspective view showing an exemplary plastic container and lid that may be assembled using a lid applying apparatus and method of the present invention.

The container 10 and lid 12 of FIG. 1 are particularly suited for storing liquid coating materials. The container 10 has a body 14 with a bottom wall 16, a sidewall 18 and a neck 20. The sidewall 18 may have any suitable cross-sectional configuration. In the illustrated container the sidewall has a rectangular configuration, in which case, at least four walls are provided. The distance between opposite sidewalls may be equal to the diameter of a conventional one gallon metal paint can or a conventional one quart metal paint can. Moreover, the effective volume within the container when the lid is applied may be identical to that of a conventional paint can, such that the container and can may be used to replace conventional paint cans. The container body 14 may have an integral handle 22 for lifting the container. A second handle, such as a bail 24, may also be provided.

The neck 20 of the container 10 may define, as shown, a wide mouth opening 26 configured with a pour spout 28 that may be located diagonally opposite the handle 22. The neck has external threads 30 for receiving mating internal threads 32 on the lid 12. The threads may be a double helix configured such that once the threads have been mated at their start points, the lid can be screwed onto the neck and sealed to the container after between one half and three quarters of one revolution.

The lid 20 has one or more projections 34 that protrude radially from an annular sidewall 36 of a body portion 38 of the lid. In the illustrated embodiment, two projections 34 are provided in the form of lugs that extend radially from diametrically opposite sides of lid's sidewall. The lugs 34 may not extend beyond the container sidewall 18 when the lid is in sealed engagement with the container. In the illustrated container 10 where the sidewall consists of four walls joined together at four corners, the lugs may be aligned over the corners when the lid is in sealed engagement with the container. Although the lid is illustrated with only two lugs, the lid may have a different number of lugs or other types of projections, and the projections may be circumferentially spaced apart. As shown, the sidewall 36 of the lid may be stepped to form a lower cylindrical portion 40 from which the lugs protrude and a smaller diameter upper cylindrical portion 42 that be provided with a textured surface, such as a grooved surface, to facilitate gripping by the fingers of a person's hand and turning of the lid relative to the container.

Figure 2:
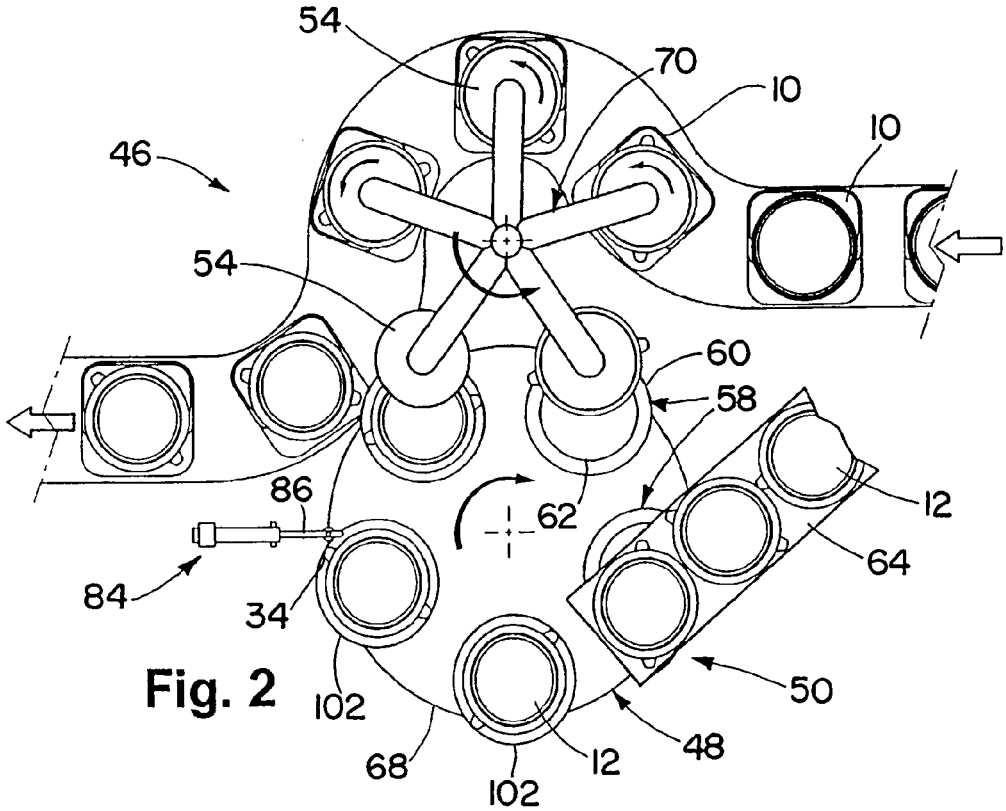
FIG. 2 is a schematic plan view of an exemplary lid applying apparatus including an exemplary lid orienting device in accordance with the invention, showing the lid orienting device just prior to engaging a projection on a lid and the lid is transported by the lid orienting device.

Referring now to FIG. 2, an exemplary lid applying apparatus is generally indicated at 46. The illustrated lid applying apparatus 46 operates automatically to apply the threaded lids 12 to the threaded necks of containers 10. The apparatus 46 includes a lid transport 48 that transports the lids sequentially along a transport path from a lid receiving station 50 to a lid transfer station 52 (see FIG. 4). At the lid transfer station 52, the lids are engaged by lid applying heads 54 that position the lids on the threaded necks of respective containers 10 that have been filled with product and then rotate the lids relative to the threaded necks to screw the lids to the threaded necks.

In the illustrated embodiment, the lid transport 46 includes lid holders 58 for holding the lid on the transport device while being transported by the transport device 48. As shown, each lid holder 58 may have a lower circular base portion 60 and an upper circular portion 62 having an outer diameter corresponding to the inner diameter of the lid 12 and a height corresponding to or less than the interior height of the lid such that the lid will be relatively closely received on the lid holder. The lid holder may also be used to catch and withdraw a lid from a lid delivery device 64. The illustrated lid delivery device 64 is a sloped chute which sequentially presents the lids to the transport device for capture by the lid holders moving therebeneath. The chute presents the leading lid at an angle sufficient to allow the lid holder to move beneath the higher end of the lid and then engage the inside wall of the lid at its lower end, such that the lid will be withdrawn from the chute as it falls into place on the lid holder.

As shown in FIG. 2, the lid transport 48 may include a turntable 68 on which the lid holders 58 are circumferentially spaced apart around the periphery of the turntable. Accordingly, the lids 12 are moved along a circular path from the lid receiving station 50 to the lid transfer station 52 while the turntable is being rotated by suitable drive means. Similarly, the lid applying heads 54 may be moved along a circular path by a rotating carriage 70 that is suitably driven in timed relation to the turntable 68. The carriage 70 also includes a mechanism for lowering the lid applying heads 54 to lower the lids onto the containers 10 moving therebeneath and for raising the lid applying heads after releasing the lids before the lid applying heads return to the lid transfer station 52. Provision is also made for rotating the lid applying heads relative to the containers after the lids have been placed on the containers, thereby to screw the lids to the containers.

The lid applying apparatus 46 as thus far described generally corresponds to a prior art lid applying apparatus used to apply lids to containers of the type shown in FIG. 1. From time-to-time, a lid 12 would be cross-threaded on the neck of the container 10 and this may result in leakage during transport of the container and lid assembly. The inventors of the present invention observed that such cross-threading most often occurred when the start point or points 74 of the threads 32 on the lid 12 when placed on the neck of the container, fell within an arcuate zone beginning at a point just past the start point or points 76 of the threads 30 on the container neck 20. The potential cross-threading zone extended in the screw-on direction (clockwise in FIG. 1) for approximately 20 degrees and is indicated at 78 in FIG. 1. In contrast, the optimal alignment zone is illustrated at 80 and extends for about 20 degrees in the screw-on direction, ending at the start points 76 of the neck threads 30. The intermittent cross-threading at least in part arose from the lids being presented to the containers at random orientations such that only some of the lids were in the orientation most prone to cross-threading whereas the majority of the lids were otherwise oriented. Also, the problem of the restricted screw landing zone is more of a problem with large flexible containers and lids such as that shown in FIG. 1 because the container opening threads can flex and be moved relative to the lid threads with the lid closing forces imposed on the system. The opening in the top of the container may be of sufficient size to accommodate a 4 inch wide paint brush and thus would have a diameter greater than about 4 or about 5 inches.

In accordance with the present invention, the cross-threading problem is solved by providing a lid orienting device that is disposed in the transport path of the lids for engaging a leading side surface of a projection on each lid to cause the lid, as it moves past the orienting device, to rotate about an axis that moves with the lid transport to a prescribed angular position relative to the transport path. As a result, the start points of the thread or threads of the lid will be positioned in a known orientation when engaged by a lid applying head at the lid transfer station so that the lid applying head can orient the lid in a known positional relationship to the thread or threads of the threaded neck of the container to protect against cross-threading of the lid when screwed onto the threaded neck.

Figure 5:
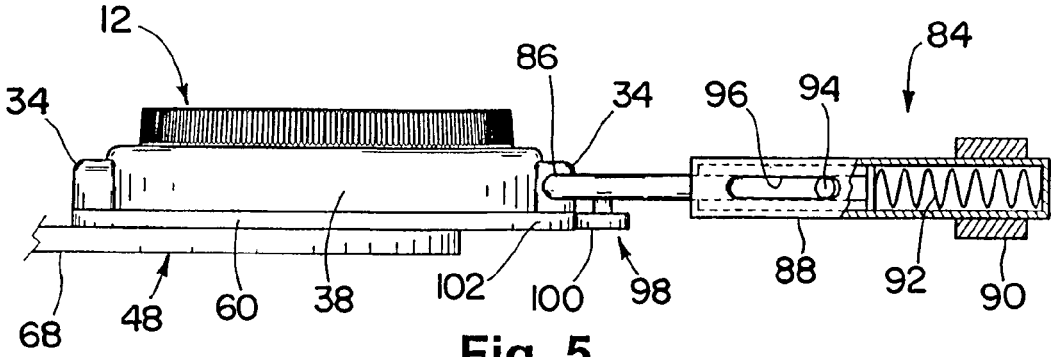
FIG. 5 is a side elevational view, party broken away in cross-section, of the lid orienting device, looking from the line 5-5 of FIG. 3.

An exemplary lid orienting device according to the invention is shown in FIG. 5 at 84. The device 84 includes a finger 86 that extends into the path of the projection 34 on the lid 12 for engaging the leading side surface of the projection as the lid moves along the transport path. The finger 86 may be mounted for movement towards and away from the transport path of the lid between a fully extended position shown in FIGS. 2 and 5 and a retracted position. In the illustrated embodiment, the finger is telescopically movable in a tubular guide 88 of a mounting structure 90 that in turn is suitably mounted in the lid applying assembly by means not shown inasmuch as any suitable mounting structure may be employed. The finger preferably is biased toward an extended position by a biasing device such as a spring 92 interposed between an inner end of the finger and an inner end of the tubular guide. The finger has connected thereto a spline pin 94 that has one or both ends thereof guided in respective slots 96 in the sidewall of the tubular guide, which arrangement prevents turning of the finger about its axis while permitting extension and retraction of the finger relative to the tubular guide. The spline pin may also cooperate with the outer ends of the slots to define a fully extended position of the finger.

The finger 86 in the fully extended position may extend into the path of the body portion 38 of the lid 12 from which the projection (lug) 34 extends, in which case it is preferable for the lid orienting device 84 to include a finger retractor 98 for retracting the finger to avoid engagement with the body portion of the lid as the lid moves past the lid orienting device. As shown in FIG. 5, the finger retractor may include a cam follower 100 in the form of a roller connected to the finger, the cam follower being positioned to engage a cam surface 102 on the lid transport to move the finger in an outward direction relative to the path of the body portion so as not to engage the body portion as the body portion moves past the lid orienting device. Each lid holder has associated therewith a respective cam surface 102 that may be formed by a radially protruding, preferably curved, more preferably arcuate, edge of the turntable 68 or edge of the base portion 60 of the respective lid holder 58.

As seen in FIG. 2, the lid orienting device 84 is strategically located so the end of the finger 86 will engage a leading side surface of a lug (or other projection) of the lid as the lid is transported past the finger. The finger is generally disposed to move toward and away from the transport path of the lids. As shown in FIG. 2, the finger extends substantially perpendicular to the transport path and thus substantially radially in the case of the arcuate transport path in the illustrated embodiment. Moreover, the location of the finger is selected such that after it rotates the lid to a prescribed orientation as discussed below, the lid, when it ultimately is placed on the neck of the container, will have the start point of the threads thereof not located in the potential cross-threading zone 78 and more preferably located in the optimal zone 80.

Figure 3:
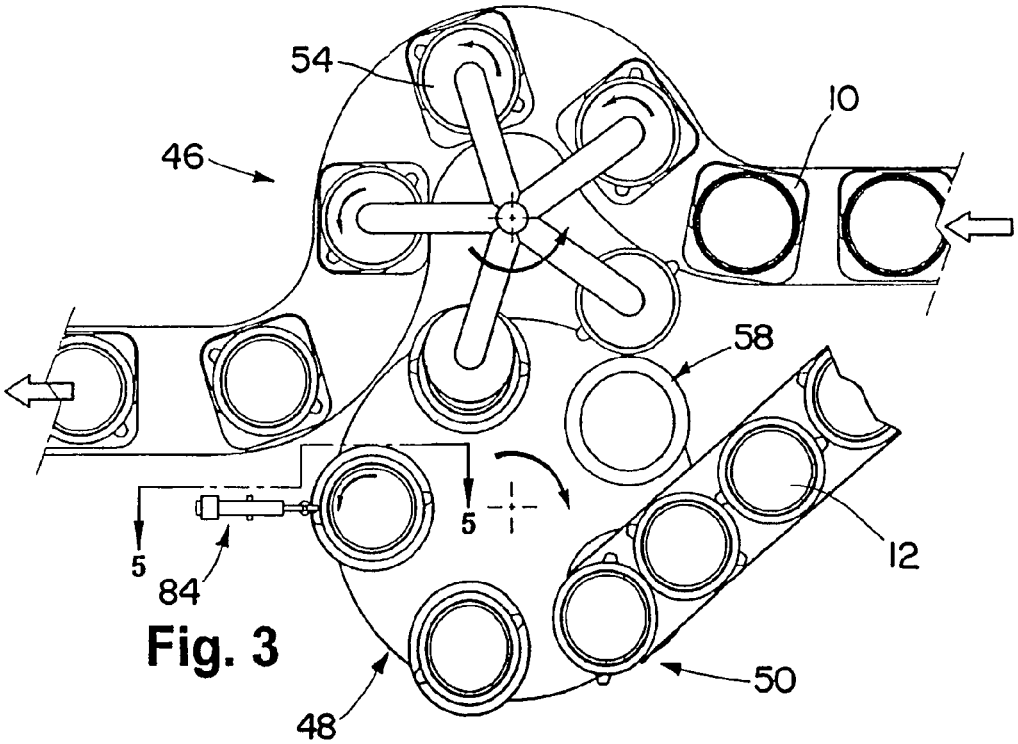
FIG. 3 is a schematic plan view similar to FIG. 2, showing the lid orienting device after engaging the projection and rotating the lid.
Figure 4:
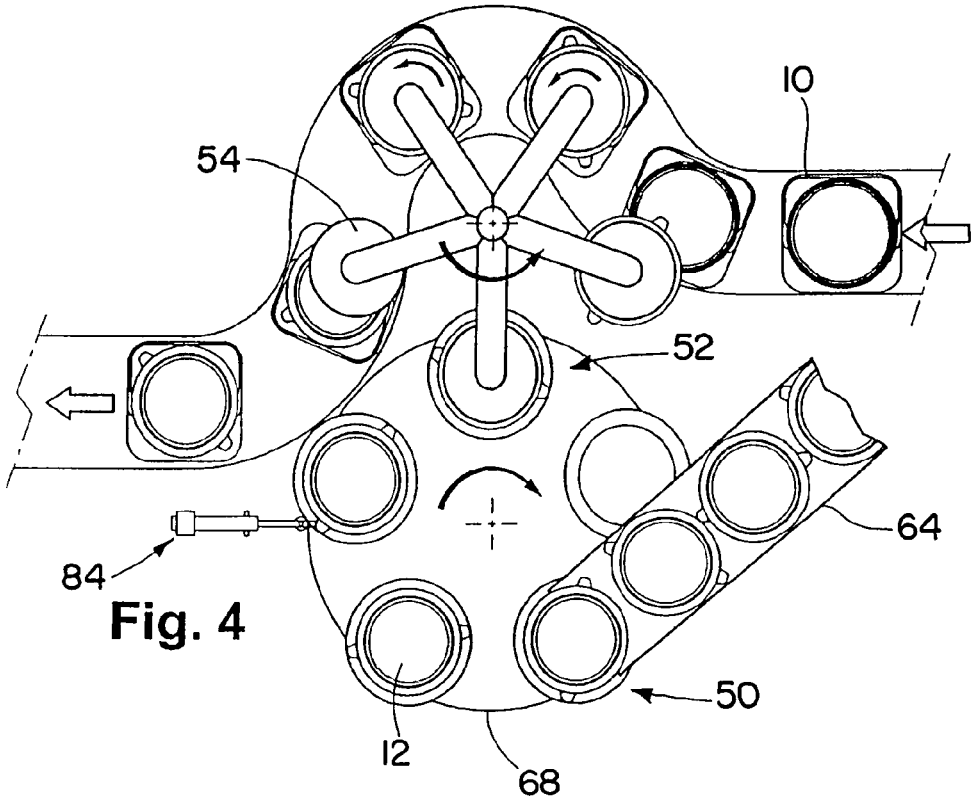
FIG. 4 is a schematic plan view similar to FIG. 2, showing the lid orienting device just prior to disengaging the projection and fully rotating the lid to a desired orientation.
Figure 6:
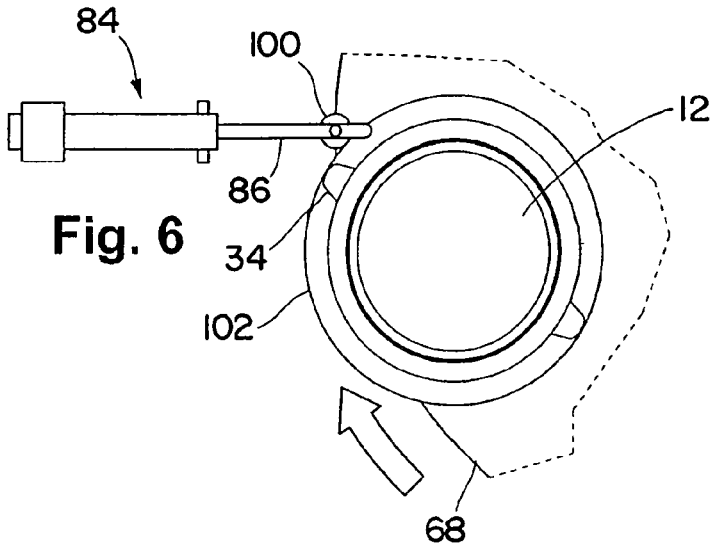
FIGS. 6-8 are enlarged, partial views showing the sequential operation of the lid orienting device illustrated in FIGS. 2-4.
Figure 7:
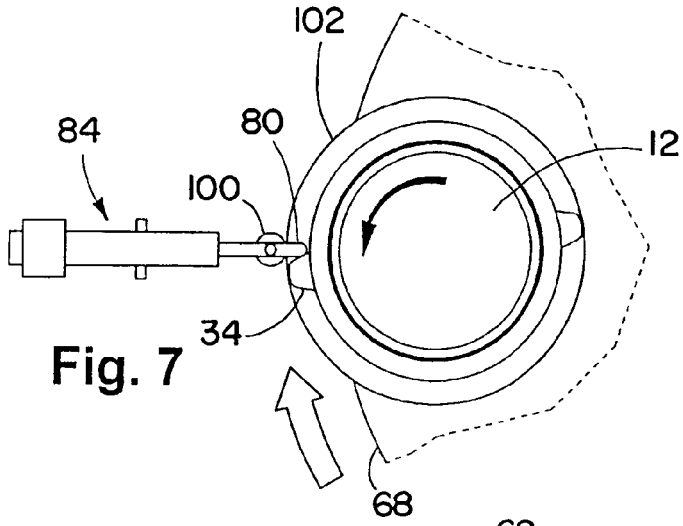
Figure 8:
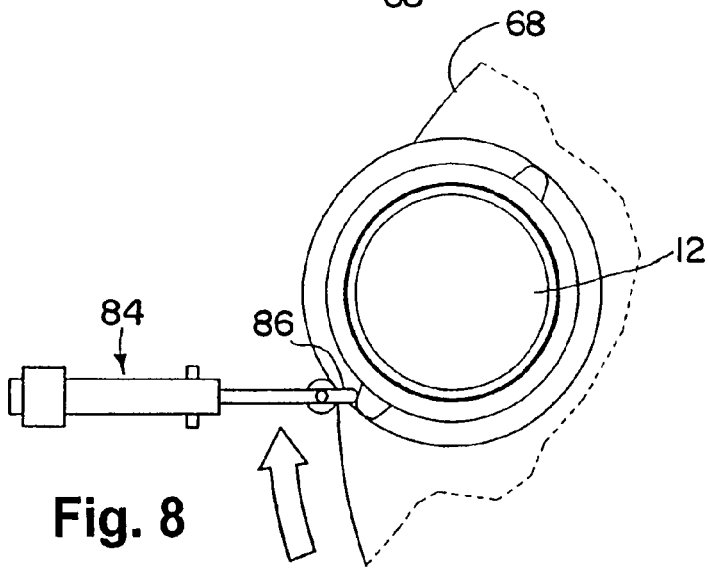

Referring now to FIGS. 2-4 and the enlarged portions thereof shown in FIGS. 6-8, the operation of the lid orientating device 84 will now be described. As will often be the case, the lids will be randomly oriented in the supply chute 64. From the supply chute the lids are sequentially loaded onto the lid holders 58 on the turntable 68 as the turntable rotates clockwise in FIG. 2. Each lid will be transported along an arcuate transport path from the loading station 50 to the lid transfer station 52. During such transport the lid will be moved toward and past the lid orienting device 84.

In FIG. 2, the finger 86 of the orienting device 84 is just about to be engaged by the leading surface of a lug 34 on the lid 12 moving therepast. As the lid moves from its position in FIG. 2 to its position in FIG. 3, the finger will engage the lug and cause the lid to rotate about the lid holder 58 as the lid continues to move along the transport path. The finger will continue to rotate the lid through the orientation shown in FIG. 3 and to the orientation shown in FIG. 4 where the finger is just about to move clear of the lug. This will orient the lid such that when it is engaged by a lid applying head 54 and placed on the neck of a container 10, the start point of the lid threads will not be located in the potential cross-threading zone 78 and more preferably will be located in the optimal zone 80.

As the finger 86 rotates each lid 12, the cam follower 100 will engage the cam surface 102 on the turntable 68 to cause the finger to retract so as not to engage the body portion of the lid as is desired. Although such engagement could be accommodated, it could interfere with free rotation of the lid on the lid holder because of frictional forces. After the center of the lid passes the finger as shown in FIG. 3, the finger will be progressively extended to maintain contact with the lug. Accordingly, the finger can engage and remain engaged with a lug over an extended range sufficient to ensure desired orienting of the lid on the turntable.

As will be appreciated, the finger need not engage and rotate every lid passing thereby. If the lid is already in an acceptable orientation, then there is no need to change the orientation of the lid. In addition, a prescribed angular orientation or position can be a range of positions.

As will also be appreciated, the position and stroke of the finger can be varied as needed to accommodate different types of lids and containers, as well as different positions of the threads on the lids and/or containers. For example, a finger may not need to retract at all in some applications.

Although the invention has been shown and described with respect to a certain embodiment or embodiments, it is obvious that equivalent alterations and modifications will occur to others skilled in the art upon the reading and understanding of this specification and the annexed drawings. For instance, the principles of the invention can also be applied to lid applying apparatus where the lids move along linear paths rather than along arcuate paths.

In regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of applying to a threaded neck of a container, lids that have at least one projection in known fixed relation to the internal lid thread or threads, the method comprising the steps of:

placing the lids on a lid holder of a lid transport that transports the lids sequentially along a transport path from a lid receiving station to a lid transfer station whereat each lid is engaged by a lid applying head used to position the lid on a threaded neck of a respective container and rotate the lid relative to the threaded neck to screw the lid to the threaded neck, the lid holder allowing the lid to rotate about an axis that moves with the lid transport; and using a lid orienting device disposed in the transport path of the lid to engage a leading side surface of a projection on the lid to cause the lid, as it moves past the orienting device, to rotate about the axis that moves with the lid transport to a prescribed angular position relative to the transport path, whereby the thread or threads of the lid will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

2. A method according to claim 1, wherein each lid has at least two projections circumferentially spaced apart by no more than 180 degrees, and the lid orienting device is located to ensure that it will engage the leading side of one of the projections as the lid passes past the lid orienting device.

3. A method according to claim 1, wherein the using step includes using a lid orienting device that has a movable finger that normally extends into the path of a body portion of the lid from which the projections protrude for engaging the leading side surface of one of the projections regardless of the orientation of the lid, and wherein the finger is retracted to avoid engagement with the body portion of the lid as the lid moves past the lid orienting device while maintaining engagement with the projection.

4. A method according to claim 3, the finger is retracted by means of a cam follower connected to the finger, the cam follower being positioned to engage a cam surface on the lid transport to move the finger in an outward direction relative to the path of the body portion so as not to engage the body portion as the body portion moves past the lid orienting device.

5. A method according to claim 1, wherein a rotatable turntable is used as a lid transport, and the lid holder is circumferentially spaced apart from other lid holders circumferentially arranged around the axis of the turntable.

6. A method according to claim 5, including the step of sequentially delivering lids in random orientation to a lid loading station whereat each lid holder has loaded thereon a respective lid upstream of the lid orienting device.

7. In a lid applying apparatus for applying threaded lids to threaded necks of containers, wherein the lids have at least one projection in known fixed relation to the internal lid thread or threads, a lid transport for transporting the lids sequentially along a transport path from a lid receiving station to a lid transfer station whereat each lid is engaged by a lid applying head used to position the lid on a threaded neck of a respective container and rotate the lid relative to the threaded neck to screw the lid to the threaded neck, the lid transport including a lid holder for holding the lid while allowing the lid to rotate about an axis that moves with the lid transport; and a lid orienting device disposed in the transport path of the lid for engaging a leading side surface of the projection on the lid to cause the lid, as it moves past the orienting device, to rotate about the axis that moves with the lid transport to a prescribed angular position relative to the transport path, whereby the thread or threads of the lid will be positioned in a known orientation when engaged by the lid applying head at the lid transfer station so that the lid applying head can orient the lid in a known positional relationship to the thread or threads of the threaded neck of the container to protect against cross-threading of the lid when screwed onto the threaded neck.

8. A lid applying apparatus according to claim 7, wherein the lid orienting device includes a finger extending into the path of the projection on the lid for engaging the leading side surface of the projection as the lid moves along the transport path.

9. A lid applying apparatus according to claim 8, wherein the finger is mounted for movement towards and away from the transport path of the lid between a fully extended position and a retracted position, the finger in the fully extended position extending into the path of a body portion of the lid from which the projection extends, and the lid orienting device including a finger retractor for retracting the finger to avoid engagement with the body portion of the lid as the lid moves past the lid orienting device.

10. A lid applying apparatus according to claim 9, wherein the finger retractor includes a cam follower connected to the finger, the cam follower being positioned to engage a cam surface on the lid transport to move the finger in an outward direction relative to the path of the body portion so as not to engage the body portion as the body portion moves past the lid orienting device.

11. A lid applying apparatus according to claim 10, wherein the transport device includes a rotatable turntable, and the lid holder is circumferentially spaced apart from other lid holders circumferentially arranged around the axis of the turntable, and the turntable has radially outwardly protruding surfaces each forming a cam surface associated with a respective lid holder.

12. A lid applying apparatus according to claim 11, wherein the radially outwardly protruding surfaces are curved.

13. A lid applying apparatus according to claim 12, wherein the lid orienting device includes a mounting member in which the finger is supported for telescoping movement, a resilient member for resiliently biasing the finger towards the turntable, and a stop for defining a fully extended position of the finger.

14. A lid applying apparatus according to claim 7, wherein the lid transport includes a rotatable turntable, and the lid holder is circumferentially spaced apart from other lid holders circumferentially arranged around the axis of the turntable and movable along a circular path when the turntable is rotated.

15. A lid applying apparatus according to claim 14, wherein the lid applying head is circumferentially spaced from other lid applying heads arranged to move along a circular path that is tangential to the circular path of the lid holders at the lid transfer station.

16. A lid applying apparatus according to claim 15, including a lid supply for sequentially delivering lids in random orientation to a lid loading station whereat each lid holder has loaded thereon a respective lid upstream of the lid orienting device.

17. A lid applying apparatus according to claim 14, wherein the finger is disposed radially outwardly of a circle defined by the center axes of the lid holders.

18. A lid applying apparatus for applying threaded lids to threaded necks of containers, wherein the lids have at least one projection in known fixed relation to the internal lid thread or threads, comprising:

lid transport means for transporting the lids sequentially along a transport path from a lid receiving station to a lid transfer station whereat each lid is engaged by a lid applying head used to position the lid on a threaded neck of a respective container and rotate the lid relative to the threaded neck to screw the lid to the threaded neck, the lid transport including a lid holder for holding the lid while allowing the lid to rotate about an axis that moves with the lid transport; and lid orienting means disposed in the transport path of the lid for engaging a leading side surface of the projection on the lid to cause the lid, as it moves past the orienting device, to rotate about the axis that moves with the lid transport to a prescribed angular position relative to the transport path, whereby the thread or threads of the lid will be positioned in a known position when engaged by the lid applying head at the lid transfer station so that the lid applying head can position the lid in a known positional relationship to the thread or threads of the threaded neck of the container to protect against cross-threading of the lid when screwed onto the threaded neck.

* * * * *